US005362030A

United States Patent [19]

Iler, Jr. et al.

[11] Patent Number: 5,362,030

[45] Date of Patent: Nov. 8, 1994

[54] FENCE POST MODULE

[76] Inventors: Ralph K. Iler, Jr.; Earl Morford, both of 1105 SE. 5th Ct., Fort Lauderdale, Fla. 33301

[21] Appl. No.: 5,093

[22] Filed: Jan. 15, 1993

[51] Int. Cl.[5] ..... E04H 17/00

[52] U.S. Cl. ..... 256/65; 256/19; 256/26; 256/24; 256/66

[58] Field of Search ..... 256/19, 26, 24, 56, 256/65, 66, 73; 403/66, 68, 69, 72; 446/122, 124, 125, 126

[56] References Cited

U.S. PATENT DOCUMENTS

| | | | |
|---|---|---|---|
| 277,493 | 5/1883 | Likes | 256/19 |
| 404,856 | 6/1889 | Ogilvie | 256/26 |
| 1,098,503 | 6/1914 | Johnson | 256/26 |
| 2,115,953 | 5/1938 | Hohmeister | 403/66 |
| 3,447,786 | 6/1969 | Bigni | 256/19 |
| 3,454,262 | 7/1969 | Romano . | |
| 3,491,984 | 1/1970 | Nyberg . | |
| 3,537,687 | 11/1970 | Adelman | 256/19 |
| 3,711,066 | 1/1973 | Niemiec | 256/19 |
| 3,822,053 | 7/1974 | Daily | 256/65 |
| 3,902,703 | 9/1975 | Bouye | 256/19 |
| 4,007,919 | 2/1977 | Totten . | |
| 4,145,031 | 3/1979 | Baker | 256/73 |
| 4,174,096 | 11/1979 | Campbell . | |
| 4,324,388 | 4/1982 | Klaser | 256/66 |
| 4,357,060 | 11/1982 | Tisbo | 256/19 |
| 4,461,461 | 7/1984 | Caron | 256/19 |
| 4,498,660 | 2/1985 | Brema . | |

FOREIGN PATENT DOCUMENTS

| | | | |
|---|---|---|---|
| 2542356 | 9/1984 | France | 256/73 |
| 3823358 | 1/1990 | Germany | 256/65 |

*Primary Examiner*—Randolph A. Reese
*Assistant Examiner*—Anthony Knight

[57] ABSTRACT

The present invention relates to a single post module which provides all the connections needed to make a fence. This module can be assembled, by unskilled persons, with other like modules to form fence posts by end-to-end assembly and connection. Each module in a post has a connector to which hollow fence rails or panel sleeves may be attached. Fence panels thus formed have a post at each end. Each module in every post has projecting hinge fins which, when overlapped with the fins of modules in similar posts, permits joining of up to four posts and their fence panels by making a pin connection at the common axis through the holes in the hinge fins at that location. This permits construction of a fence which can branch into as many as three new fences at any location. Further, because the fence comprises independent panels connected by pin connections, any panel or pair of adjacent fence panels can be converted into a gate by removal of a pin connector at any number of desired locations along any portion of the fence. The fence may be permanently or temporarily installed depending on how the pin connector is installed: the fence may be freestanding, straight or polygonal in layout, or anchored by pin connectors in set into a footing or driven into the earth.

12 Claims, 8 Drawing Sheets

FENCE POST MODULE

BACKGROUND

1. Field of the Invention

Figure 1:
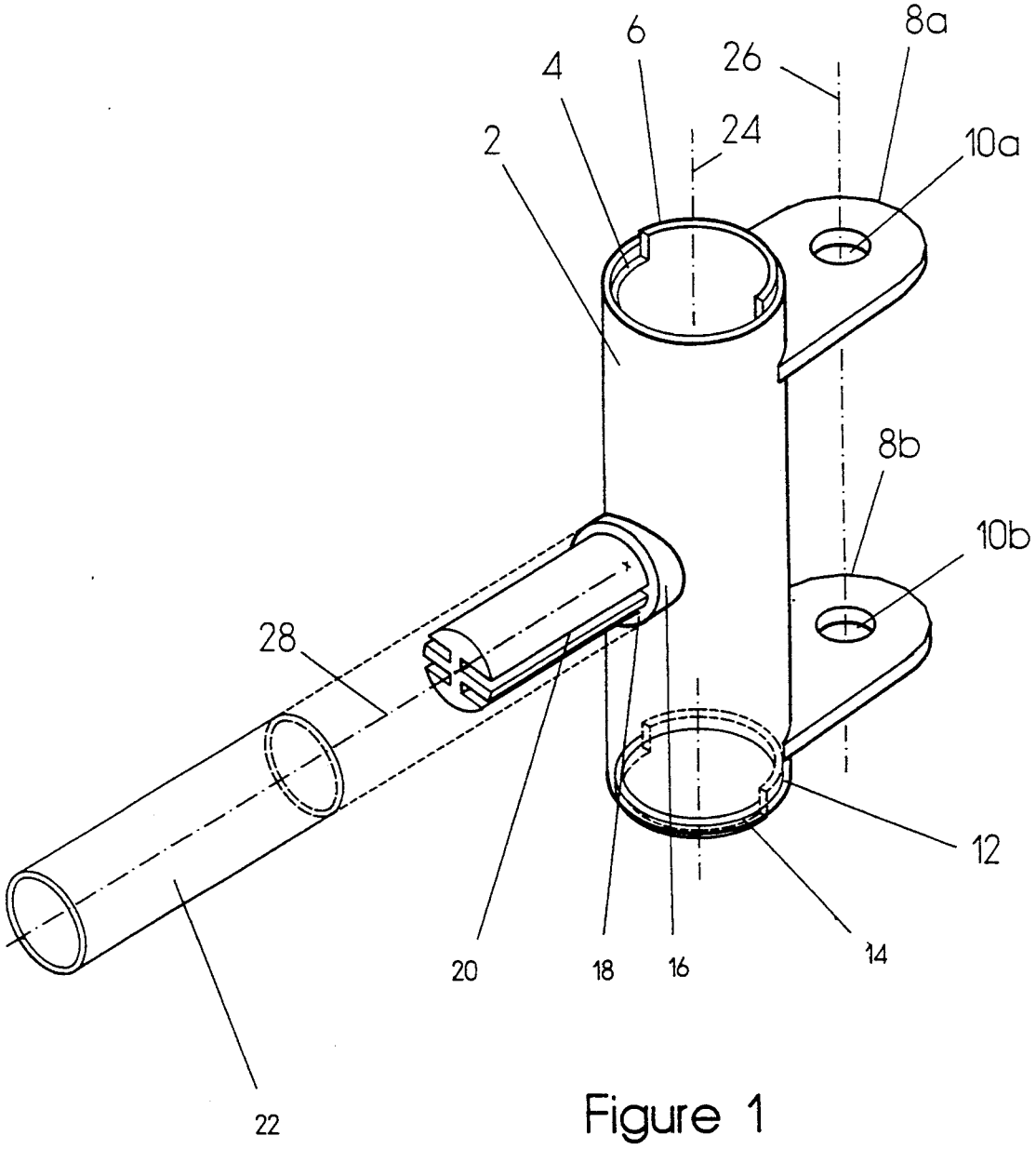

This invention relates to fences, especially those to be used for visual barriers, for decorative effect, for animal containment, for light-duty crowd control, and for a variety of other functions where this contemporary and abstracted equivalent of a split-rail fence might be used. This invention is a condensation and simplification of the components and connections from which fences are made.

2. Description of Prior Art

Heretofore, fences have been designed to be installed using posts of pre-cut lengths, which are designed to accept prefabricated fence panels or panel material (such as woven wire chain-link fence "cloth") which come in a limited number of predetermined widths. These fence posts and panels, or rails, are then connected by a variety of hardware components (such as u-bolts, clamps, to fit end-posts of panels to be mounted, etc.) or by the fitting together of posts and panels by the geometry of pegs, projections, rails, or end-posts with receiving holes, slots, or other configurations. One odor art fence is designed to be assembled from a kit of parts fabricated to work to together in a fence system. These fence systems are usually too complicated for the average user to assemble and are commonly installed by commercial distributors and fence specialists who also sell the components.

All fences are modular in that they are made up of a limited number of structural components used repetitively. A modular fence system is desirable if it has a combination of characteristics including the following: low initial cost of parts, lightweight components of small size and therefore easily transported and handled; easily and quickly assembled at the site by unskilled labor; requiring the fewest possible subassemblies or components to constitute a complete system; capable of being assembled into a wide variety of sizes and configurations; capable of extension of reduction of height or length; capable of being reinforced as needed to increase strength to meet loading requirements; capable of being converted between any two posts to a gate; capable of disassembly without destruction of fence panels and posts for re-use elsewhere; and being aesthetically attractive.

All of the foregoing are desirable, if not necessary, of maximum performance in a fence system and hence for value to the fence owner. Prior art fences, "modular" or not, have fallen short on one or more of the above characteristics, even though their general desirability was recognized.

For support and anchorage, most fence posts require several feet of length, beyond what will be above ground, to go into the earth or a concrete footing. This extra length (and weight) adds difficulty to transpod, handling, and it adds cost. Posts are commonly made in standard lengths: if the user needs a different length, he must cut off and waste materials, or he must pay a premium price for a custom length. Most prefabricated fence panels tend to be large, heavy, and/or awkward to handle. There is no easy way to vary the length of such panels to fit dimensions in the field. Panel materials are usually fabricated in a limited variety of lengths for the manufacturer's convenience and economy of production, and for competitive pricing. Most users have, until now, had to rely on sellers or contractors for pads, installation, and service. Installation by the fence supplier, or by a third-party contractor, usually increases the owner's cost, per linear foot of fence, by a factor of two or more.

One prior art fence, the "Modular Fence System" (U.S Pat. No. 4,498,660), comprises individual louver blade modules (affording visual privacy while maintaining free airflow.) Each louver module is an element of both fence post and fence panel and comprises a single, sloped, louver blade having at opposite ends, alternating, offset cylinders of ½ the louver-module height, such that consecutive louvers can be joined at their ends, threaded over prefabricated posts, pipes, or rods which link the louvers in a structural, pin-connection. Louvers may be of any length and may be arranged in any continuous, linear, polygonal layout as long as the louver-linkage continuity is maintained. Disadvantages in this system include the lack of provision for any kind of opening or gate in the fence (other than a fence discontinuation,) virtually no adaptability to changes in terrain elevation or slopes, and no provision for three- or four-way fence intersections (as at corners of adjoining properties) without disruption of the vertical spacing between louvers.

Another prior art fence, the "Fence" (U.S. Pat. No. 4,174,096,), comprises complete panel modules, with end extensions similar to those cited above, which may be formed in any continuous, straight, zig-zag, or polygonal configuration, by making vertical pin-connections between consecutive panels. The panel modules are to be pin-connected with pipes, posts, or rods. Some of the same disadvantages described above apply to this system. There is no separate "post" in this system. The complete panels represented in the "Fence" patent could be awkward to handle due their size and/or weight (a typical fence layout has posts set eight feet apart.) This system can be set up to form multi-fence intersections, but the spacing of the louvers would be changed and the privacy provided by the louvers would be lost if branching to create new fence runs were attempted. There is no indication that this fence system can be adapted to varied ground slopes, due to the fixed sizes and rectangular shapes of the fence panels, without again varying the louver spacing. Disassembly of this fence is simple: pull out the pin connectors and all the louvers fall to the ground; or, lift off the entire top row of louvers, followed by the second, third. . . etc. Re-use of the louvers requires complete reassembly of the fence.

The patent for "Interchangeable Fence Construction" (U.S. Pat. No. 3,454,262) describes another type of fence comprising discrete posts and wood panels. Its claim is for the interchangeability of prefabricated panels mounted between pre-installed posts. Design of the panel field may be infinitely varied, but the panel perimeter shape and size is always the same, making it interchangeable between posts. The design variation of the panel "field" is the basis of this patent, and panel design is not relevant to the present invention.

"Fence Structure" (U.S. Pat. No. 4,007,919) claims an "H"-shaped post and plastic-foam-filled, plastic, rectangular rails which fit into the slots of the "H" posts. The rail in the post slot is the primary claim, It is presumed that the post must be set into the ground for stability. This type of fence is only capable of straight-line layout, but it is capable of adapting to changes of ground slope because the post slot is deep enough to permit vertical rotation of the rails in the slot before they are fixed or pinned to the post. There is no provision for making a gate within the system. Also, there is no provision for multi-fence intersections (branching to form new fence runs) because each post has but two, opposing, longitudinal slots, A multi-slotted post is a possibility, but that is not the primary claim, The slotted post is not germane to the present invention.

The"Modular Railing Assembly" (U.S. Pat. No. 3,491,984) claims a post and rail system which focuses on the joining of hollow metal or plastic post and railing components by means of a spline which fits and locks into both top of post (notched) and adjoining (hollow) rail (s). Each joint of this railing assembly system requires a number of components to achieve all the required connections. This modular assembly may be adapted to other than straightline layout, but adaptation to changes of ground or balcony elevation is difficult, if not impossible. A gate function is not part of this invention, nor is provision for branching at multi-fence intersections. This invention is primarily aimed at balcony or wall railing applications and is not relevant to the present invention.

OBJECTS AND ADVANTAGES

Accordingly, we claim the following as the objects and advantages of our invention:

- to provide a fence-post module which comprises, in a single, easily handled component, three different connecting means as follows: end connections from said post module to additional post modules above and/or below it: lateral connection to adjacent fence sections through formation of a unique, hinged, double-post between adjoining fence sections; lateral connection to fence panel elements, such as fence rail or fence panel components and connectors;
- to provide a fence post module having all connections necessary to make a fence, with which an unskilled person may assemble and erect a fence of any desired height, on flat or hilly ground, in straightline or zigzag layout;
- to provide a modular fence post with the inherent capability of accommodating additional, branching, fence runs at any post location, without disassembly of the posts or fence panels at any given location, after the original fence has been installed;
- to provide a modular fence which accommodates removal and relocation of fence sections, without dismantling the rest of the fence adjacent to said sections;
- to provide a fence post module which permits addition or removal of fence post modules at any previously installed fence post location in order to increase or decrease fence height without demolishing or removing the entire post;
- to provide a fence post module which permits conversion of any section of fence from a fixed panel into a swinging gate (or any two adjacent, fixed, fence panels into a pair of swinging gates) and conversely, to provide a fence post module which permits any section of fence that is being used as a gate to be convened into a fixed panel in the fence;
- to provide a fence post module which permits construction of a fence without footings or, if desired, without any connection whatever with the ground and which, through its formation of hinged posts, may be set up in staggered, zig-zag layout to provide required stability without footings, which facilitates simple, temporary installation and removal of entire, assembled, lightweight fence sections;
- to provide a fence post which permits installation of additional fence runs at any given modular fence post within an arc of 95 degrees to either side of the plane containing the axes of post body, post connector, and fence connector, hereafter referred to as the "central plane";
- to provide a fence post module which, by the proper positioning of its lateral, post-connecting means, can be used to assemble a hinged double-post without a vertical offset, of the fence post module body, caused by turning one module upside down in relation to the other and connecting it with said other;
- to provide a fence post module which permits construction of either permanent or temporary fence;
- to provide a fence post module which, by virtue of the central cavity common to all fence post module, may be internally reinforced with a variety of materials until the post in question is strong enough to meet a broad range of static and dynamic loading requirements;
- to provide a fence post module which will reduce the number of, or eliminate, separate special hinges and fittings while providing gate-hinge capability.

Further objects and advantages of our invention will become apparent from a consideration of the drawings and ensuing description of the invention.

DRAWINGS FIGURES

FIG. 1: fence post module, shows an overall axonometric view of the fence post module and the relations of the fence connector (20) to the fence rail or fence panel element (22) as well as the opposed position of the post connectors (8*a* and 8*b*), about the body (24); further, the relationships of post connector lips (6 and 14) and recesses (4 and 12) may be seen. Note that, in the preferred embodiment illustrated, the axes of the fence connector holes (10*a* and 10*b*), the fence connector (20), and the post module body axis (24) lie in the same plane, which is referred to as the "central plane."

Figure 2:
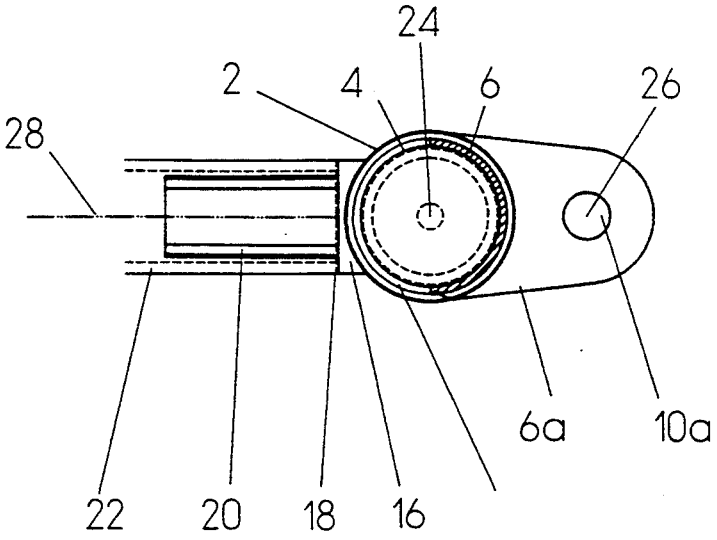

FIG. 2: shows a top view (bottom view similar) of a fence post module.

Figure 3:
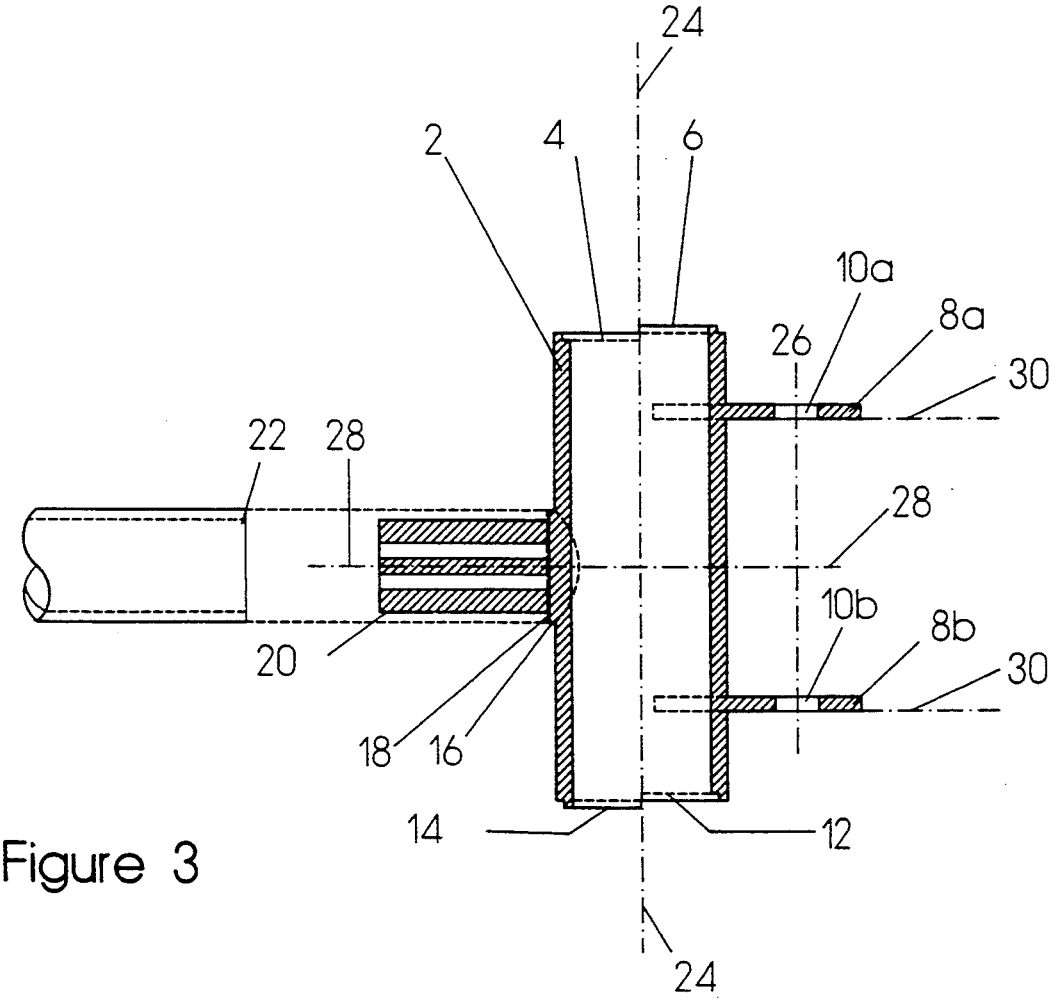

FIG. 3: shows a side cross-sectional view of the fence post module. Note that the post connectors (8*a* and 8*b*) are offset to one side of the fence connector plane of contact (30).

Figure 4:
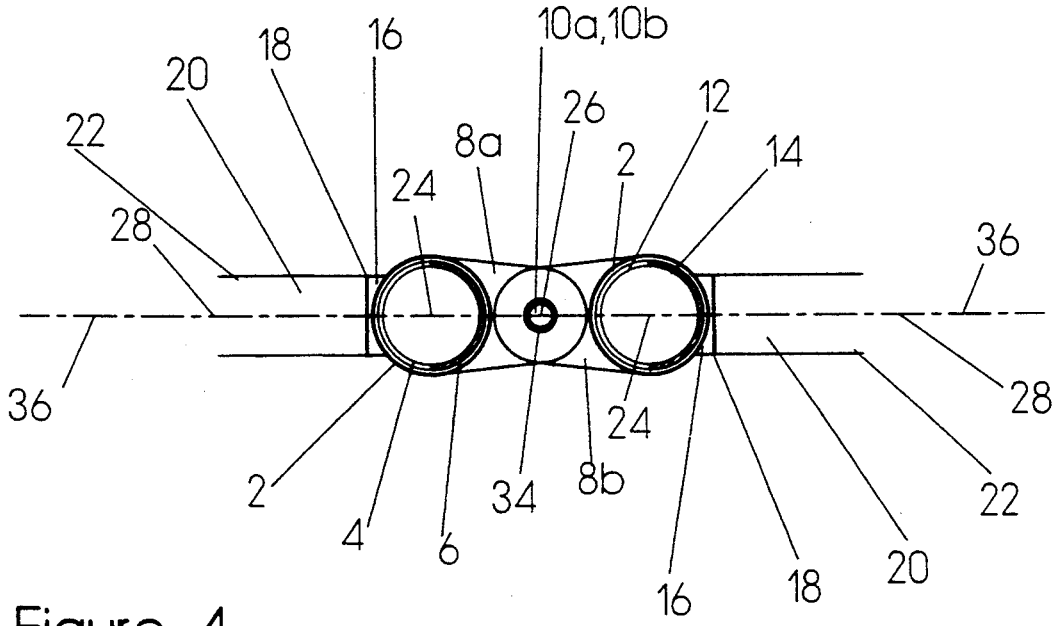

FIG. 4: shows the top view of two post modules, linked by the fence connectors (8*a* and 8*b*) between adjoining fence sections and forming a unique, hinged, double-post.

Figure 5:
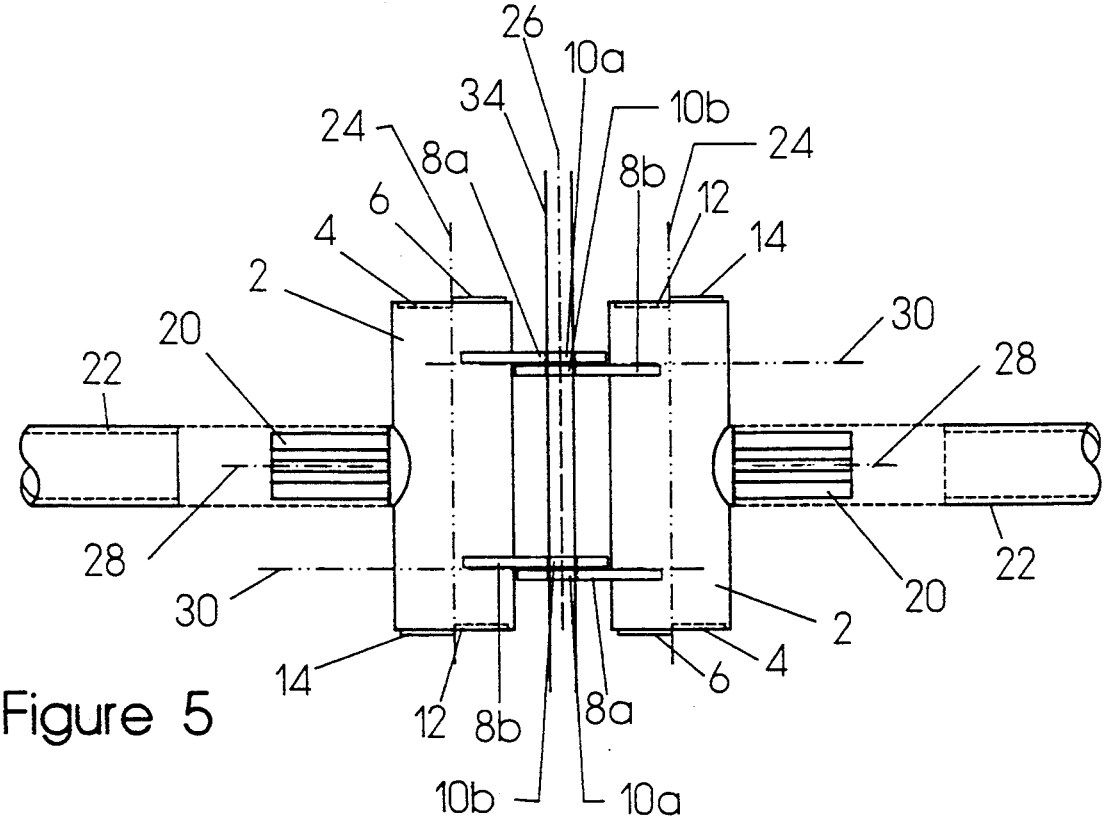

FIG. 5: provides a side view showing two post modules linked by their post connectors. Note that the right-hand module is identical to the left-hand module, except that it has been turned upside down, rotated about the fence connector axis (28), so that its post connectors are below the plane of contact (30), and so that the post module bodies are at the same elevation (i.e. have not been offset vertically by the rotation because the post connectors have been offset from the planes of contact (30)). The two planes of contact are equidistant from the common, fence connector axis (28).

Figure 6:
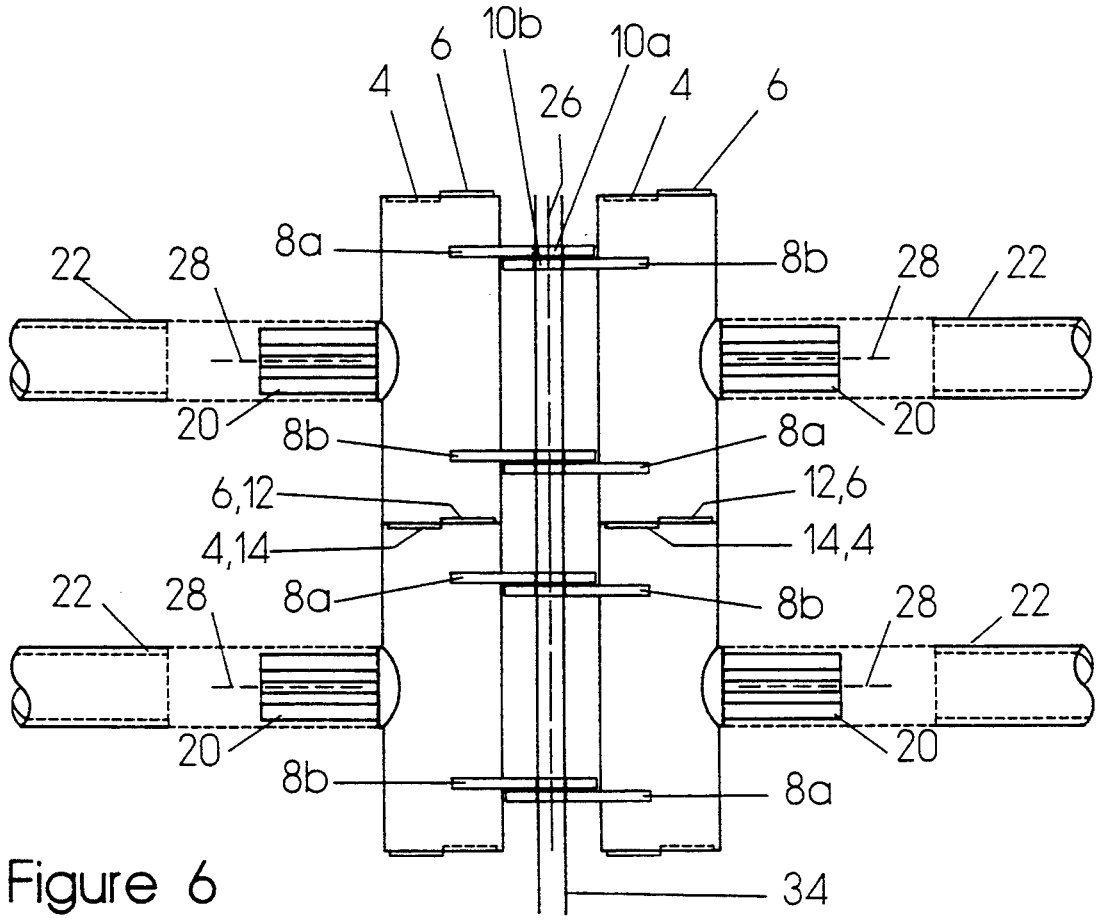

FIG. 6: gives a side view of two fence posts comprising two post modules each.

A post of any desired height may be assembled by plugging together the required number of fence post modules, through use of their end-connecting means, the arcuate male lip (6 and 14) and the arcuate female lip recess (4 and 12) in the preferred embodiment shown.

Figure 7:
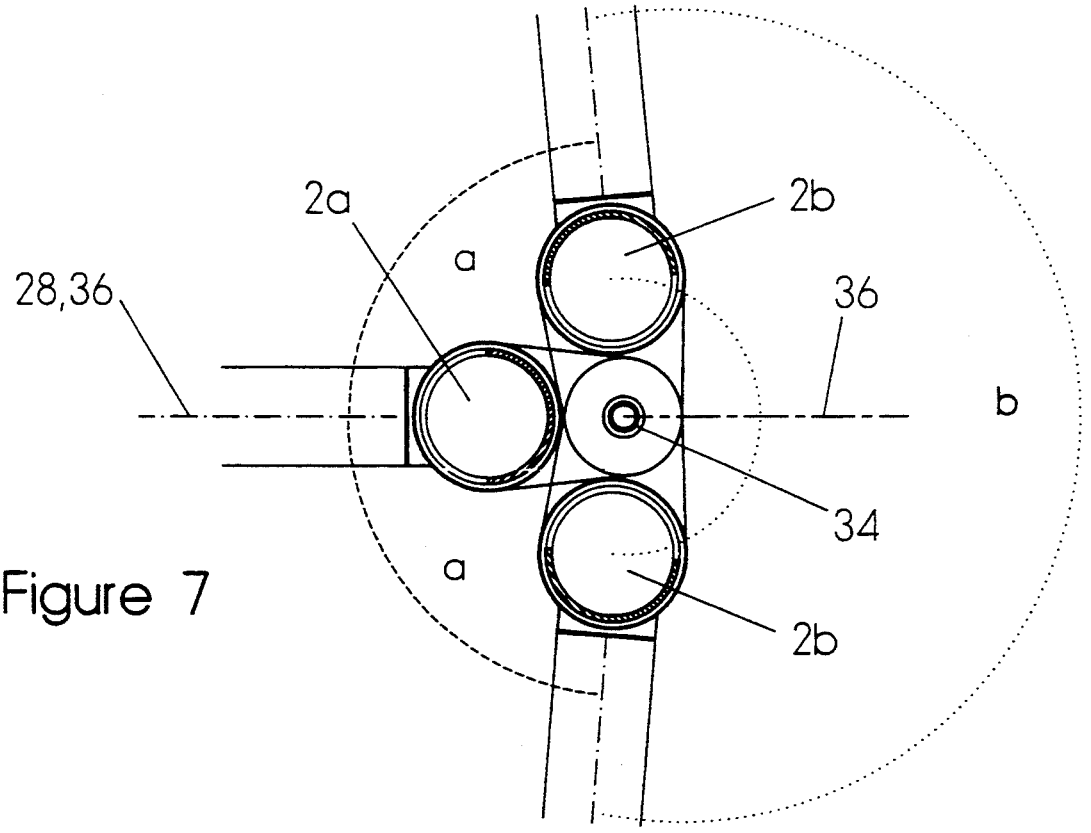

FIG. 7: illustrates the potential for the hinged rotation of one post module about another at a typical, hinged-post joint. In the preferred embodiment shown, module (2*b*) is free to swivel through, or be positioned anywhere within, an arc of approximately 190 degrees (arc b), approximately 95 degrees minimum to either side of the central plane (36) of module (2*a*), FIG. 8: shows how three posts may be joined via their post connectors. As more posts are added, the freedom of rotation shown as (arc b) in FIG. 7 is progressively more restricted, by increments of approximately 85 degrees (arc "a") in the preferred embodiment, because each additional post module may not rotate toward an adjacent module inside limiting arc "a", which is dependent upon post connector length in relation to post-module-body diameter.

Figure 9:
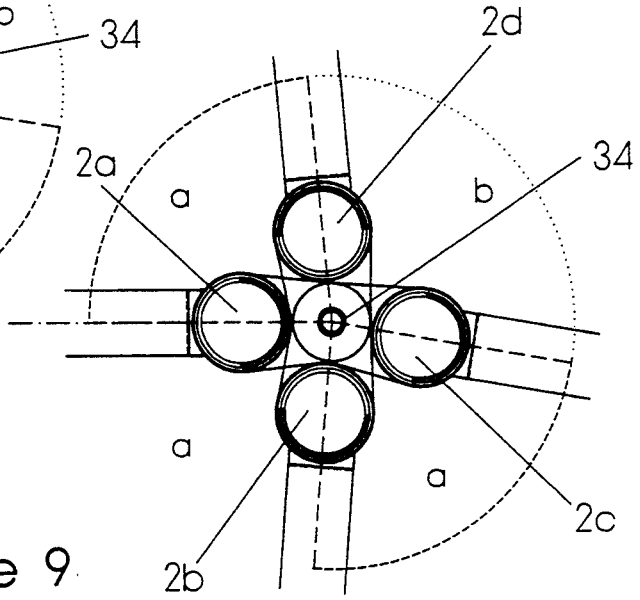

FIG. 9: illustrates the joining of four posts via post connectors.

Figure 10:
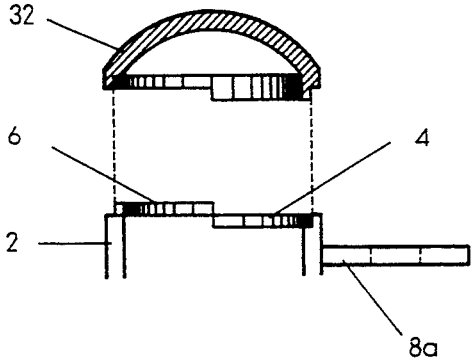

FIG. 10: shows a cross-sectional view through the fence post cap, which is designed to plug onto either end (whichever is the "top") of any fence post module, at the top of every modular fence post, by virtue of its connecting means.

Figure 11:
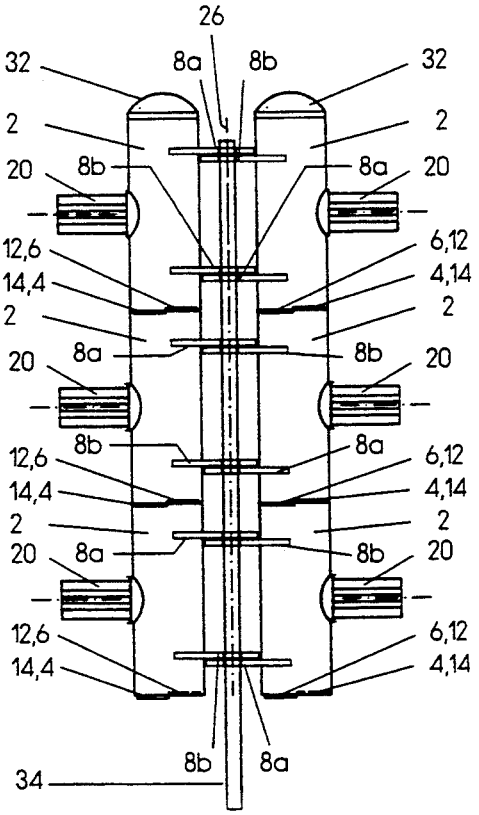

FIG. 11: shows a side view of a hinged double-post with cap which is three modules high, with post connector axes (26) coincident. Note that the pin connector (34), when installed, causes vertical alignment of all connecting means.

Figure 12:
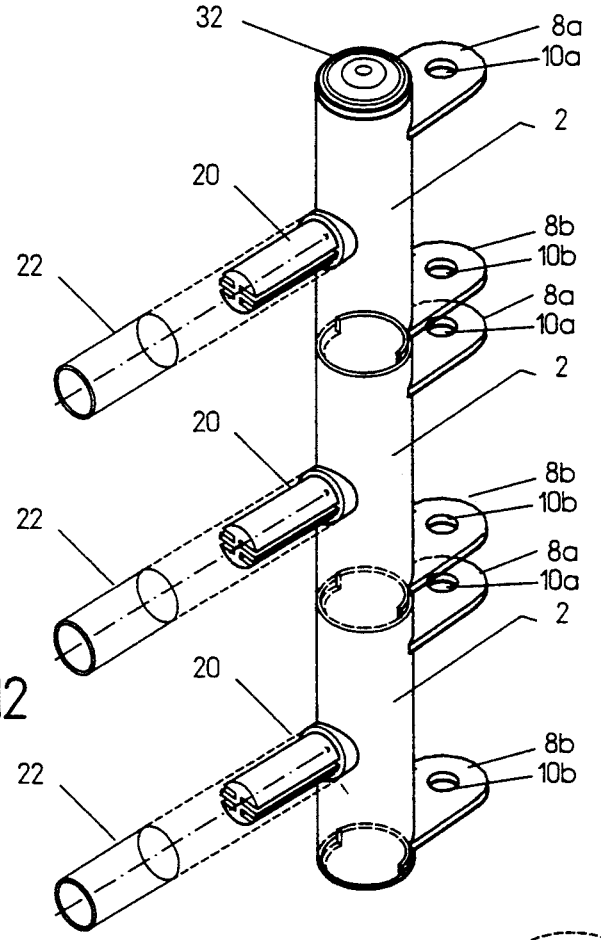

FIG. 12: is an axonometric view of a three-module post with cap.

Figure 13:
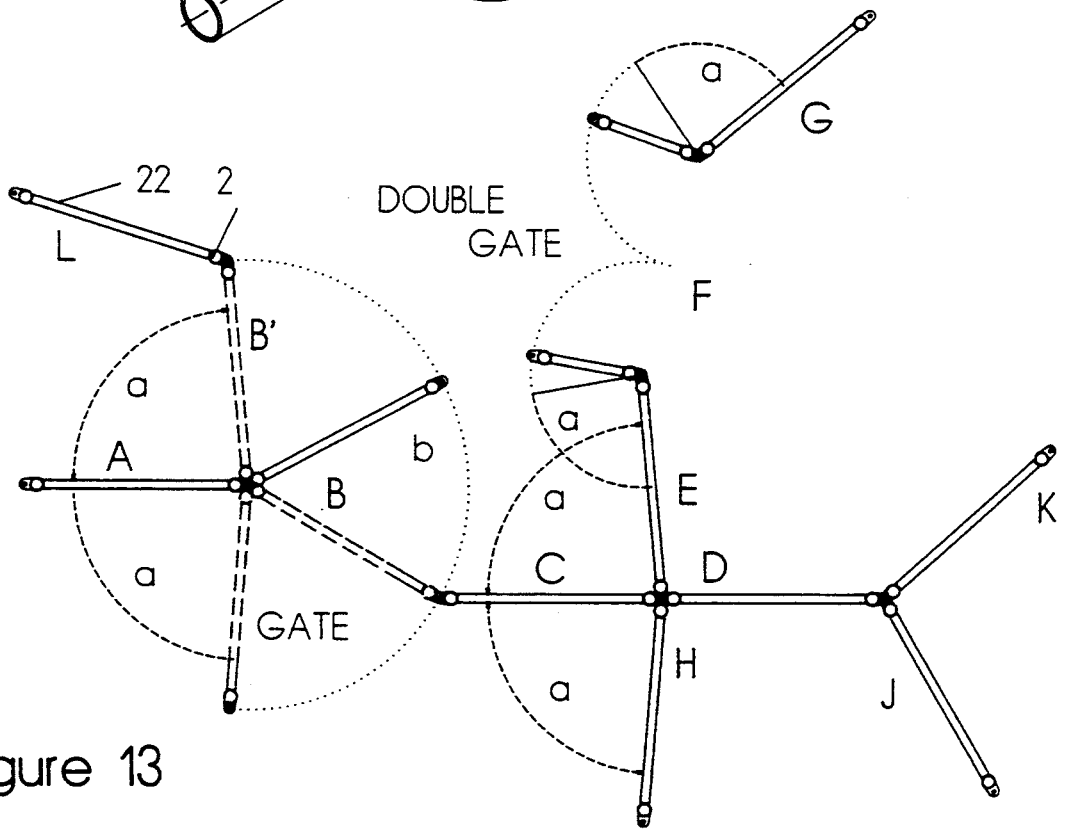

FIG. 13: shows the flexibility of fence run layout which is possible through use of the fence post module and the resulting hinged double-posts. Any fence panel (B) may be converted to become a gate (B') or gates as at (F). Most panel lengths shown are equal, but fence panel length is not germane to this invention. Note how gate swing arcs and fence run angles are limited to the supplementary angle of arc (a) throughout the layout.

Figure 14:
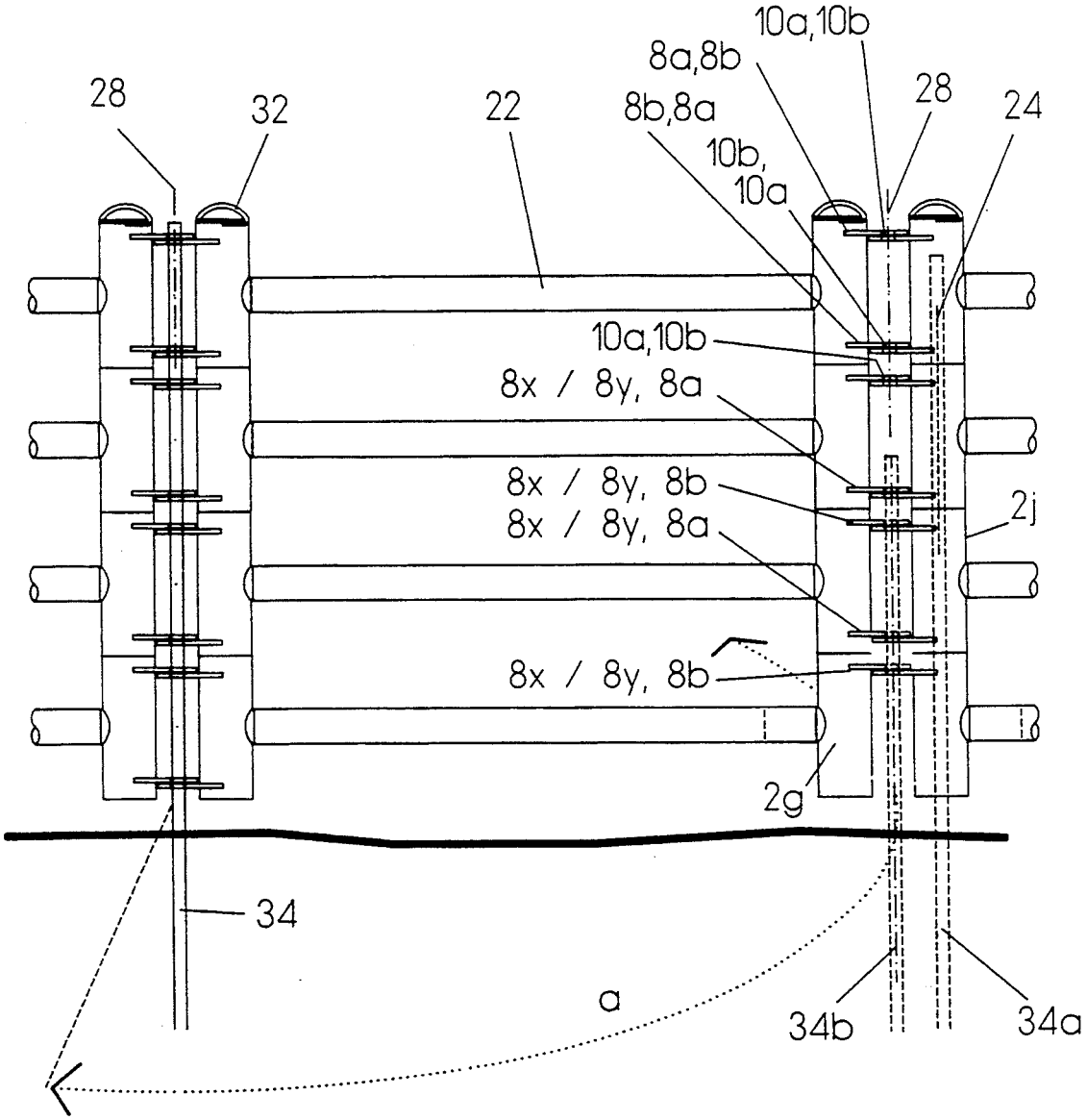

FIG. 14: illustrates the gate function of the hinged double-post. Note that the greater the number of fins (post connectors, 8*a* and 8*b*) left attached to the post, the greater the number of locations there are for locking the gate; however, only a single fin is needed to secure the gate. The pin connector (34*a*) may be installed inside the jamb-post body to stabilize the post and to leave the post connectors free at the "jamb" side of the gate for the full height of the post. An equally practical way to convert a fence panel to a gate, and still stabilize the post, is indicated in FIG. 14 at the pin connector (34*b*) which has been inserted through some, but not all, of the lower jamb-post connectors. The upper post connector holes (10*a* and 10*b*) are left open and free to accept a lock, pin, chain, etc. to keep the gate closed. Because the lower post connector holes are filled by the pin connector (34*b*), the corresponding lower post connectors on the gate must be modified either by cutting one side to allow the gate-side post connectors (8*x*) to fit over the pin connector (34*b*) or by cutting them off entirely (8*y*). A heavy line represents the ground surface on which the modular fence is installed.

Figure 15:
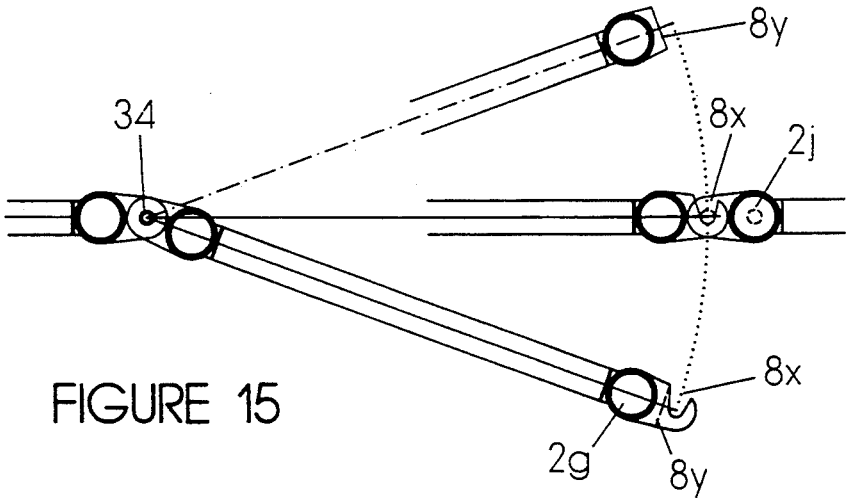

FIG. 15: is a plan view of the gate shown in FIG. 14 and illustrates alternatives for modifications which are required to convert a fence panel to a gate. Specifically, this figure shows how the lower post connectors (8*x*) may be modified to act as stops, to limit gate swing to one side of the fence, by cutting away a portion of it to open one side of the gate-post connector hole (10*a* and 10*b*), to permit the gate to rotate horizontally to its stopped position on the above pin connector (34*b*), where the axes of the post connector holes (10*a* and 10*b*) are coincident. Also shown is the post connector modification (8*y*), wherein the end of the gate-post connectors are cut off to allow them to rotate past the pin connector (34*b*) and to make a two-way gate-swing possible.

Figure 16:
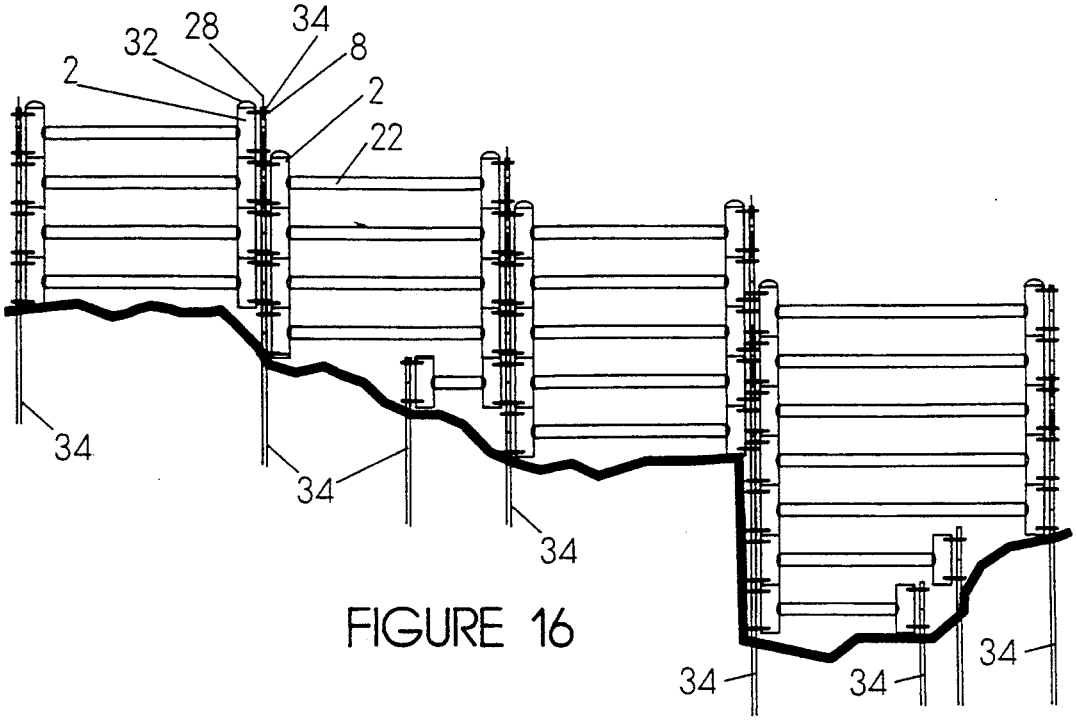

FIG. 16: shows how the fence post module may be used to adapt the fence to changes of grade elevation by varying the number of modules in each post and by varying or offsetting the elevations of the posts relative to each other. There is a plurality of connectors on each post, and there is a plurality of positions in which posts may be linked vertically to accommodate terrain level changes, all the while maintaining the flexibility and function of the hinged double-post.

Figure 17:
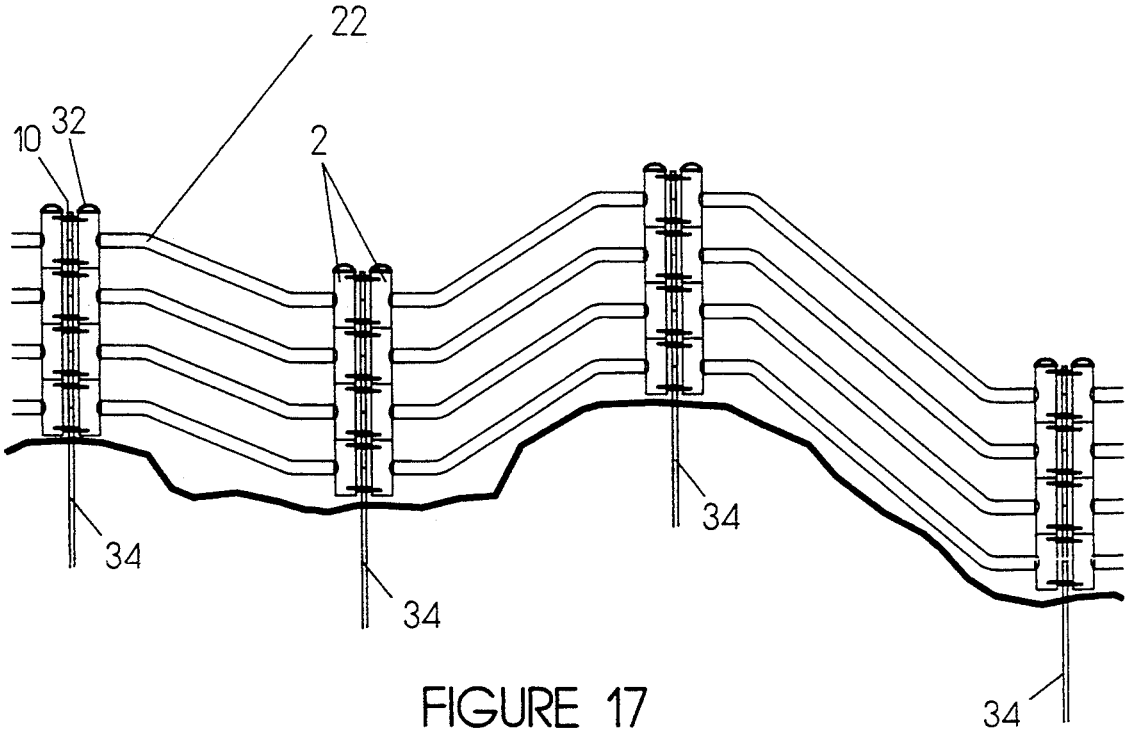

FIG. 17: shows how the fence post module may be used in combination with the flexible fence rails or panels (not part of this invention) to allow the fence to be adapted to land contours with posts, of equal and constant height, which are not offset in relation to each other.

DRAWING REFERENCE NUMERALS

2 body
2*a* first post
2*b* second post
2*c* third post
2*d* fourth post
2*g* gate post, part of gate panel created by modifying post connectors
2*j* jamb post, created by changing installation of pin connector (34) installation or position
4 arcuate female connecting and indexing lip recess, negative of corresponding male connecting I and indexing lip (14) on opposite end, part of longitudinal connector
6 arcuate male indexing lip, negative of corresponding female connecting and indexing lip recess (12) on the opposite end, part of longitudinal connector.
8*a* lateral, upper post module connector, also acts as a hinge
8*a*, 8*b* 8*a* situated above 8*b*
8*b* lateral, upper post connector, also acts as a hinge
8*b*, 8*a* 8*b* situated above 8*a*
8*x* notched post connector, acts as single-swing gate stop as part of gate (Refer to FIGS. 14 and 15 for "x" and "y" designations
8*y* Truncated post connector, permits double-swing gate without stop, i.e. gate section swings past post position
8*x*/8*y*, 8*a* 8*x* or 8*y* above 8*a* below
8*x*/8*y*, 8*b* 8*x* or 8*y* above 8*b* below
10*a* hole in 8*a*
10*b* hole in 8*b*
10*a*, 10*b* 10*a* above 10*b*
10*b*, 10*a* 10*b* above 10*a*
12 arcuate female connecting and indexing lip recess, negative of corresponding male connecting and indexing lip (6) on opposite end, part of longitudinal connector
14 arcuate male connecting lip and indexing lip, negative of corresponding female connecting and indexing lip recess (4) on opposite end, part of longitudinal connector 16 lateral, fence connector boss with outer dimension(s) to match outer dimension(s) of fence panel element or fence rail 18 shoulder, serves as a stop for fence panel element (22) and its width matches fence panel element or fence rail thickness to produce a flush joint 20 fence connector to match inside dimension of (22)

22 fence panel element or rail to be connected to (20)

24 axis of fence post module body (2), coplanar with axes (26, 28, and 30)

26 axis of post connector hole (10*a* and/or 10*b*), coplanar with body axis (24)

28 axis of fence connector, coplanar with body axis (24)

30 axis of symmetry about fence connector axis (28), coplanar with, equidistant from, and parallel to fence connector axis in the preferred embodiment of the invention 32 fence post cap with connecting lip recess and projecting lip which mate with post connecting means (4, 6) and (12,14)

34 pin connector or hinge pin, depending on use of fence panels which it links 36 central plane, contains axes 24, 26, and 28

Figure 8:
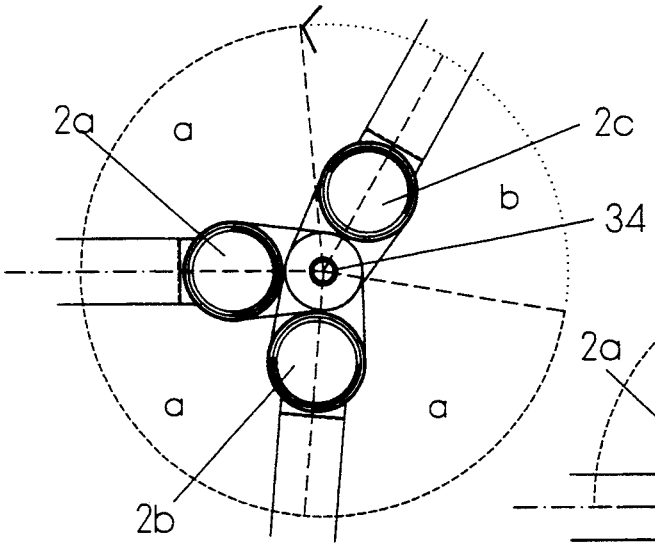

38 jamb post, stationary, at end of fence panel and fence section 40 gate post, vertical post at end of swinging gate a supplement of maximum angle, measured to either side of central plane (36), through which a post module or fence panel used as a gate can swing, approximately 85 degrees according to the preferred embodiment of the invention, refer to FIGS. 7, 8, and 12 b free-swing arc available to any module at a given joint, varies with number of modules connected at a given location, refer to FIGS. 7, 8, and 12

Fence Post Module: Detailed Description of the Invention Including Preferred Embodiments Following is a detailed description of some of the preferred embodiments of this invention and these are connected by reference to the accompanying figures: where an individual, structural or geometric element is depicted, it is assigned a common reference numeral.

Preferred embodiment of Fence Post Module: FIG. 1 (axonometric view) shows a fence post module according to the preferred embodiment of the invention. The module comprises a cylindrical body with a full-length cavity parallel to the cavity axis (24); "upper" and "lower" lateral, "post connectors" which are the fins (8*a* and 8*b* respectively) projecting from and perpendicular to the surface of said body, each fin having in it a hole (10*a* and 10*b*) more fully described below ; a lateral "fence connector" (20) which also projects from said body perpendicular to said axis (24); and curved male lip connectors (6, top and 14, bottom) with corresponding curved, female lip connector recesses (4, top and 12, bottom).

Number of lateral connectors: Note that while the preferred embodiment of the invention has two post connectors and one fence connector, the post module may be formed with fewer than, or more than, the two post connectors shown; and, it may be formed with more than one fence connector shown or with none at all.

Number of longitudinal connectors: a longitudinal connecting means, the lip(s) and lip recess(es) found at the ends of said module body in the preferred embodiment, must be provided on each end of each post module body.

Post module cross section: The post module may be made with any cross section, i.e. having its shape generated by a line of any length, perpendicular to the plane of its directrix and moved along the directrix perimeter, which may be a circle or any other closed curve or polygon (to form a cylinder in the preferred embodiment). The result of this geometry will be termed a "cylinder" below, defined as a generic three-dimensional form generated by a straight line moving along any closed-loop directrix, with wall thickness determined by intended application of the module.

Post module body length and diameter: In the preferred embodiment of the invention, with a single fence connector, the length of the cylindrical body (2) determines the spacing between the fence connectors (20) of adjacent post modules. In its preferred embodiment, the module body is approximately 7" long. A second embodiment of the invention (not illustrated) may have a plurality of fence and post connectors projecting from said module body. In its preferred embodiment, the inside diameter of the module body will be approximately 1/32" larger than the outside diameter of standard 2" (diameter) schedule 40 pvc (polyvinyl chloride) DVW (drain/vent/waste) pipe.

Longitudinal Connectors: On each end of the module body, the curved male lip connector (6, 14), in the preferred embodiment, is semi-circular and approximately 3/32" thick by ⅜" high, the height being measured parallel to the body axis (24) away from the end of said module body; the corresponding female, curved, lip connector recess (4, 12), in the preferred embodiment, is approximately 3/32" wide and ⅜" deep, exactly and negatively matching the dimensions and curvature of said male lip.

Longitudinal Connectors: Number of lips and lip recesses: While the preferred embodiment has only one lip and one recess on each end. In a second embodiment, both lip and recess may be made multi-toothed and multi-recessed to produce a connection analogous to the interlocking "finger joint" seen in the wood products industry.

Longitudinal Connectors: Shape of Lips and Lip Recesses: The lips and lip recesses cited above are arcuate (curved), but if, in another embodiment of the invention, the "cylinder" has a polygonal or continuously curved cross section other than circular, then said single or multi-toothed lip(s) and recess(es) must follow the shape of the cross section and thus be something other than circular arcs, e.g. they must be curved or polygonal to conform to module body cross-sectional shape.

Post Connectors: In the preferred embodiment, there are two post connectors (8*a* and 8*b*) on each module body (2), in the form of fins which are approximately ¼" thick, approximately 3⅝" long, approximately 2½" wide at (and where the sides are tangent to) the module body, (narrowing to approximately 2" where the connectors have radial ends,) and which are integrally formed with the module body. There is a necessary hole (10*a* and 10*b*) in each post connector (8*a* and 8*b*). These holes, in the preferred embodiment, are concentric about axis (26), parallel to the axis of the module body (24), concentric with the radial ends of the post connectors (fins) above, and have a diameter of approximately 13/16" to allow passage of a ¾" diameter metal or polymer rod, pipe, or pin, through some or all post connectors (8*a* and 8*b*) in any given fence post or group of posts to be connected,

Post Connector location along module body: The post connectors are integrally formed with the post module body (2), perpendicular to it and to its axis (24), and in the preferred embodiment, located so that the lower side of each connector contains the plane of symmetry (30) about the fence connector axis, as shown in FIGS. 3 and 5.

Fence Connector: In the preferred embodiment, the fence connector (20) is located opposite the post connectors (8*a* and 8*b*) with respect to the module body axis (24) and lies in the central plane (36), centered along and perpendicular to the module body (2) and its axis (24). Said fence connector is integrally formed with a cylindrical boss (16) which itself is integrally formed with the module body and post connectors. The boss extends approximately ⅛" from the outer surface of the module body and terminates in a plane perpendicular to the fence connector axis (28) and to the fence connector for which it is the base. The boss diameter is designed to match the outside diameter of standard 1½" (diameter) schedule 40 PVC (DVW) pipe. The fence connector (20) is concentric with the boss.

Fence connector boss and shoulder: Because the fence connector in the preferred embodiment is generally cylindrical in form (very slightly tapered or "drafted", to a smaller diameter at its outer end), and is designed to match the inside diameter of standard 1½" schedule 40 PVC pipe, the fence connector does not cover all of the circular face of the boss. This annular surface, or"shoulder" (18), is closely approximate in width to the wall thickness of the above schedule 40 PVC pipe. This creates a flush joint where PVC fence rail (pipe) or fence panel connector meets the post module (FIGS. 2–8, 11, 13–15).

Fence connector geometry: While the geometry of the fence connector shown (FIG. 1) is the preferred embodiment, different geometry may be used for the fence connector to adapt it to other pipe or fence panel connectors of cross-section different from what is illustrated in the figures. Specifically, the fence connector may be rectangular or of any other cross-sectional shape as long as it provides a connecting means for the fence post module. Should other pipe-wall thicknesses be used, the shoulder width of the module may be varied to match it and to retain the flush joint. Should a fence rail or panel connector cross-section other than circular be used, the fence connector boss cross-section and shoulder can be modified to retain a flush joint with the rail or panel.

Other embodiments of the invention may eliminate the projecting fence connector altogether or substitute at least one fence rail or fence panel receptor-hole in the wall of said body, said hole being intended to receive a fence rail or fence panel element by insertion.

Modular fence post cap: In order to close the open end of the uppermost post module in each post, a cap, shown in FIG. 10, will fit the lip and recess configuration of the module. The cap's top surface, in the preferred embodiment of the invention, will be shaped to shed water, as in the partially spherical surface illustrated.

Material (s) Of Construction: The material from which the fence post module is made is selected based upon economic, structural, practical, and aesthetic factors. In the preferred embodiment of the invention, PVC (polyvinyl chloride), injection-molded and formulated with additives and copolymers to improve physical properties, is the material preferred for manufacture of this invention. Formulations employing other engineering polymers, such as polyethylene, polybutylene, acetal, and ABS would also serve well as materials for manufacture of the fence post module.

Fence Post Module: Operation

Post assembly and longitudinal connections: The novel fence post module is built into a fence post by stacking and "plugging" one module into the top or bottom of another until a post has been built to desired length. Stacking and connection of the modules is facilitated by the presence of a male connecting lip as shown in FIGS. 1, 6, 10, and 11 (6, 14) which projects from each end of each module and which fits into a corresponding recess also in the end of each module (4, 12). Refer to FIG. 1 to see the relationship of male connector to female recess in the same module.

Longitudinal connecting means_Lip and Lip recess: The function of end-of-module lip and recess connections is twofold: first, they provide a simple means for achieving mechanical linkage and gluing-surface area between modules; second, they insure proper and automatic alignment of fence and post connectors of all post modules, which are plugged together like children's blocks or stick toys (refer to FIGS. 6, 11, and 12.)

Post connector Hinge: Another novel feature of this fence post module is that, when post modules and modular posts are linked-by their post connectors, the result is a unique, hinged, double-post which greatly enhances the flexibility of application and fence installation (see FIG. 13). The double-posts and hinges (post connectors) provide new and original, aesthetic and visual interest at the end of every fence panel, through their physical shapes, variety of spatial arrangements, and mechanical relationships as illustrated in FIGS. 14, 16, and 17. While the post module in the preferred embodiment of the invention has two post connectors, a post module may have no connectors at all; however, the post module may also have any desired number of post connectors.

Plurality of posts: In the preferred embodiment of this invention, the minimum number of posts at any fence panel intersection is two posts as shown in FIGS. 4, 6, 11 and 13. It is possible to install each post in a single-post, free-standing mode, but this manner of installation will not gain the benefits provided by the hinged double-post. The single-post configuration will naturally occur at the ends of fence runs which do not form enclosures: at these locations, the post connectors (hinges) will be used to receive the last pin-connector as shown in FIG. 16 (34). Because each fence panel has a post at each end, once assembled, the fence may be dismantled in panel form (post-panel-post), moved about, and reinstalled in a different layout in the same place or at another site. In the preferred embodiment of the invention, it is also possible to link and hinge together as many as four posts (FIGS. 9 and 13). As shown in FIGS. 8 and 9, the freedom of movement available at any intersection (arc "b") is inversely proportional to the number of fence panels connected at any given location. The hinged-post capability provides much greater flexibility, in layout and use, than that available in any prior art post of any description.

Internal reinforcement: The inside diameter of the post module is designed to accept internal reinforcement in the form of concentric pipe or rods of metal or polymer (indicated as unnumbered dashed circle in FIG. 2.)

Fence panel assembly: To assemble a fence panel in the preferred embodiment of the invention, the user must build the desired posts from post modules. Then she may apply adhesive to the fence connectors and slip the pipe rail material onto the connectors. Once the adhesive has set, the panel is ready for installation. (A slip-fit connection, without glue, may be satisfactory for some applications.) By combining fence panels of any desired length(s) by means of the hinged fence posts, the user can build virtually any desired pattern or shape of fence or enclosure.

Flush joint: The design of the fence connector, which inserts into the fence rail (pipe) or fence panel connector permits the formation of a flush joint at the fence connector boss (16) on the post module (refer to FIGS. 1–8, 12, 14–17). This flush joint feature provides a major aesthetic improvement over connections made with commonly available external PVC fittings as seen in PVC furniture: the flush joint gives the final, assembled fence a visual continuity of surface and smoothness of line which no fence or furniture, made with commonly seen external fittings and shoulders, can match.

Pin connector: In the preferred embodiment of the invention, reinforcing steel rod, (34) in FIGS. 14–16, and 17, treated to prevent rust, is the material of choice for forming fence post "pin" connections through the post connectors. A second function of this continuous rod is to add stability to the modular fence post by preventing rotation of the individual modules constituting it. Two post connectors (hinge fins) on each module assure that there be no rotation about a horizontal axis, while rotation may freely occur about the vertical axis of the pin connector (and of holes 10*a* and 10*b*). This reinforcing steel may be set in concrete below grade, in concrete above grade for easy relocation, or may be driven directly into the earth. Galvanized steel pipe will also work well as the pin connector material. Other pin connector options (not illustrated), where anchorage to the ground is not required, include bushings or sleeves with retainer rims which can be dropped into the holes of the post connectors to act as individual pins at each individual hinge; these bushings may be made long enough to run through more than one post connector hinge thereby stabilizing the joints between post modules, in a fashion similar to the pin connector. Bushings may be introduced, with or without pin connector installation, to reduce wear in the gate hinge surfaces where gate operation is frequent or gate loading is heavy.

Gate location: Because of the post connector (hinge) configuration, a gate may be formed at any fence panel or adjacent pair of panels. Where a gate is to be created, the post module supporting the latch-side of the gate may be given steel reinforcement as in FIGS. 14 and 15 (34*a* or 34*b*). Where the gate is to be temporary, reinforcement can be lighter and not permanently installed in concrete below grade. As shown in FIG. 15, the post connectors may be modified in at least two ways: they may be notched (8*x*), and they may be cut off or truncated. Not all post connectors need be modified: only those which will be impeded in their passage by the pin connector (34*b*), as shown in FIG. 14, need to be changed. Later, if the gate is no longer required, the pin connector (34*b*) may be removed and a new pin may be installed to extend to the top post connector, (such as is shown at the left side of FIG. 14), which has not been modified and thus can restore the integrity of the fence.

We claim:

1. A fence post module comprising:

a cylindrical member of a predetermined length having first and second ends;

the first end including a lip extending partially around the perimeter of the first end and a lip recess also extending partially around the perimeter of the first end;

the second end being a mirror image of the first end such that the first end of one cylindrical member can be attached to a second end of another cylindrical member;

a fence connector extending outwardly from the cylindrical member between the first and second ends for attaching a fence rail to the cylindrical member; and at least two post connectors extending outwardly from the cylindrical member in a direction opposite to the fence connector, the first post connector being positioned inwardly from the first end a first predetermined distance and the second post connector being positioned inwardly from the second end a second predetermined distance, the second predetermined distance being generally equal to the first predetermined distance plus the thickness of the post connector, each fence post connector including a hole such that two adjacent fence post modules can be joined by insertion of a pin when the adjacent fence post modules are positioned with the first end of one being adjacent to the second end of the other.

2. A fence comprising:

at least one fence panel composed of a plurality of fence post modules, each fence post module including:

a cylindrical member of a predetermined length having first and second ends;

the first end including a lip extending partially around the perimeter of the first end and a lip recess also extending partially around the perimeter of the first end;

the second end being a mirror image of the first end such that the first end of one cylindrical member can be attached to a second end of another cylindrical member;

a fence connector extending outwardly from the cylindrical member between the first and second ends for attaching a fence rail to the cylindrical member; and at least two post connectors extending outwardly from the cylindrical member in a direction opposite to the fence connector, the first post connector being positioned inwardly from the first end a first predetermined distance and the second post connector being positioned inwardly from the second end a second predetermined distance. the second predetermined distance being generally equal to the first predetermined distance plus the thickness of the post connector, each fence post connector including a hole such that two adjacent fence post modules can be joined by insertion of a pin when the adjacent fence post modules are positioned with the first end of one being adjacent to the second end of the other;

two ends with said fence panel having at least two of said fence post modules at each end; and at least one rail extending between said fence panel ends and attached to one of the fence connectors on one end of said fence panel and also attached to the corresponding fence connector at the other end of said fence panel.

3. The fence as recited in claim 2 wherein said rail is curved to adapt to the slope of the ground where the fence is to be erected.

4. The fence as recited in claim 2 wherein a pin passes through the holes of the post connectors on only one end of the fence panel so that the fence panel forms a swinging gate.

5. The fence as recited in claim 2 wherein at least three panels are joined together at their respective post connectors to form an intersection that divides an area into a corresponding number of sections.

6. The fence as recited in claim 2 wherein the fence post modules are made of a plastic material.

7. The fence as recited in claim 6 wherein the fence post modules are adhesively bonded together.

8. The fence as recited in claim 2 wherein the fence post modules are supported by central posts that pass through the interior of each said cylindrical member.

9. The fence as recited in claim 7 wherein said fence panel is attached to another fence panel of similar construction, and wherein said another fence panel is also supported by central posts.

10. The fence as recited in claim 2 wherein said fence connectors and said post connectors are generally 180° apart.

11. The fence as recited in claim 10 wherein said fence post module permits installation of additional fence runs within an arc of 95° of the central plane, the central plane being defined by the axis of said cylindrical member and said fence connectors and said post connectors.

12. The fence as recited in claim 2 wherein the uppermost fence post module is topped by a cap having a closed top and a bottom having a lip and recess that correspond to the lip and recess of said uppermost fence post module.

* * * * *